US005435228A

United States Patent [19]

Snitgen

[11] Patent Number: 5,435,228

[45] Date of Patent: Jul. 25, 1995

[54] PNEUMATIC TRANSFORMER

[76] Inventor: Joseph D. Snitgen, 18828 Hillcrest, Beverly Hills, Mich. 48025

[21] Appl. No.: 320,753

[22] Filed: Oct. 11, 1994

Related U.S. Application Data

[63] Continuation-in-part of Ser. No. 95,159, Jul. 20, 1993, Pat. No. 5,353,683.

[51] Int. Cl.[6] ..... F15B 11/08

[52] U.S. Cl. ..... 91/444; 91/519; 60/426

[58] Field of Search ..... 91/170 R, 174, 177, 91/444, 446, 448, 517, 518, 519; 60/413, 420, 426, 459

[56] References Cited

U.S. PATENT DOCUMENTS

| | | | |
|---|---|---|---|
| 186,539 | 1/1877 | Carr et al. . | |
| 319,901 | 6/1885 | Groshon . | |
| 1,690,126 | 11/1928 | Nielebock . | |
| 3,170,379 | 2/1965 | Dempster . | |
| 3,410,089 | 11/1968 | Snitgen . | |
| 3,410,182 | 11/1968 | Snitgen . | |
| 3,488,957 | 1/1970 | Snitgen . | |
| 3,731,592 | 5/1973 | Kreiskorte . | |
| 3,786,725 | 1/1974 | Aoki . | |
| 3,832,849 | 9/1974 | Lang . | |
| 3,882,761 | 5/1975 | Snitgen . | |
| 4,439,986 | 4/1984 | Snitgen . | |
| 4,455,828 | 6/1984 | Snitgen . | |
| 4,630,442 | 12/1986 | Massaro et al. . | |
| 5,067,389 | 11/1991 | St. Germain . | |
| 5,113,907 | 5/1992 | Russell | 91/448 X |
| 5,115,720 | 5/1992 | Babson et al. | 91/448 |
| 5,163,353 | 11/1992 | Horstmann et al. | 91/448 X |
| 5,184,535 | 2/1993 | Kimura | 91/444 X |
| 5,199,658 | 4/1993 | Bartels et al. . | |
| 5,353,683 | 10/1994 | Snitgen | 91/444 |

FOREIGN PATENT DOCUMENTS

0296047A1 12/1988 European Pat. Off. .

*Primary Examiner*—Edward K. Look
*Assistant Examiner*—Hoang Nguyen
*Attorney, Agent, or Firm*—Harness, Dickey & Pierce

[57] ABSTRACT

A fluid operated device has a high pressure fluid cylinder, a low pressure fluid cylinder and a plurality of valves which operate to fluidically connect the two cylinders to provide a compound fluidic device. The device utilizes the exhaust of the high pressure cylinder as input to the low pressure cylinder thereby increasing the amount of work obtained from the pressurized fluid. In the preferred embodiment, the fluid operated device is connected to a compressing cylinder which, through operation of the fluid operated device, increases the fluid pressure of a working fluid. The plurality of valves includes a pair of two-way valves and two quick exhaust valves to increase the cycle speed of the fluid operated device.

16 Claims, 4 Drawing Sheets

PNEUMATIC TRANSFORMER

CROSS REFERENCE TO RELATED APPLICATIONS

This application is a continuation-in-part of U.S. application Ser. No. 08/095,159, filed Jul. 20, 1993, now U.S. Pat. No. 5,353,683.

FIELD OF THE INVENTION

The present invention relates to a dual cylinder double acting pneumatic transformer. More particularly, the present invention relates to a dual cylinder double acting pneumatic transformer incorporating a unique valving system to control the flow of fluid between the two cylinders.

BACKGROUND AND SUMMARY OF THE INVENTION

Machines using fluid motors (e.g. pistons and cylinder assemblies) for clamping, actuating tools or welding guns, etc. are generally either pneumatically or hydraulically powered. If high speed operation of the fluid motor is required, compressed air is the preferred power source because it is cleaner and gives faster action than pressurized oil at the same supply pressure. The source for compressed air is normally a facility wide supply system and the compressed air is provided at a system pressure. This system pressure may or may not be compatible with the amount of work required by the fluid motors. Where a large amount of energy is required, any attempt to utilize the system pressure will result in air cylinder sizes which are too large for many applications. Pressurized oil can be used at higher pressures than compressed air, thereby reducing cylinder sizes, but to get fast action, relatively large displacement pumps are required. Hydraulic power units for these systems tend to be large and costly, and because they have continuously operating pumps, they consume substantial amounts of power, are a source of continuous noise and generate considerable heat because all excess oil is pumped back to the reservoir after being raised to working pressure. This continuous operation of the hydraulic power units occurs even during the dwell or rest portion of the load cycle, because the pumps must be able to quickly meet any sudden demand. Variable displacement pumps may consume only a moderate amount of power, but these pumps are even more costly to purchase initially.

It is therefore an object of the present invention to provide an improved fluid power supply which operates on demand only basis to combine the load being exerted by a primary cylinder with the load exerted by a secondary cylinder.

It is a further object of the present invention to provide a third cylinder coupled to the primary and secondary cylinders to provide pressurized fluid at a pressure which is greater than the supply pressure on a demand only basis.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
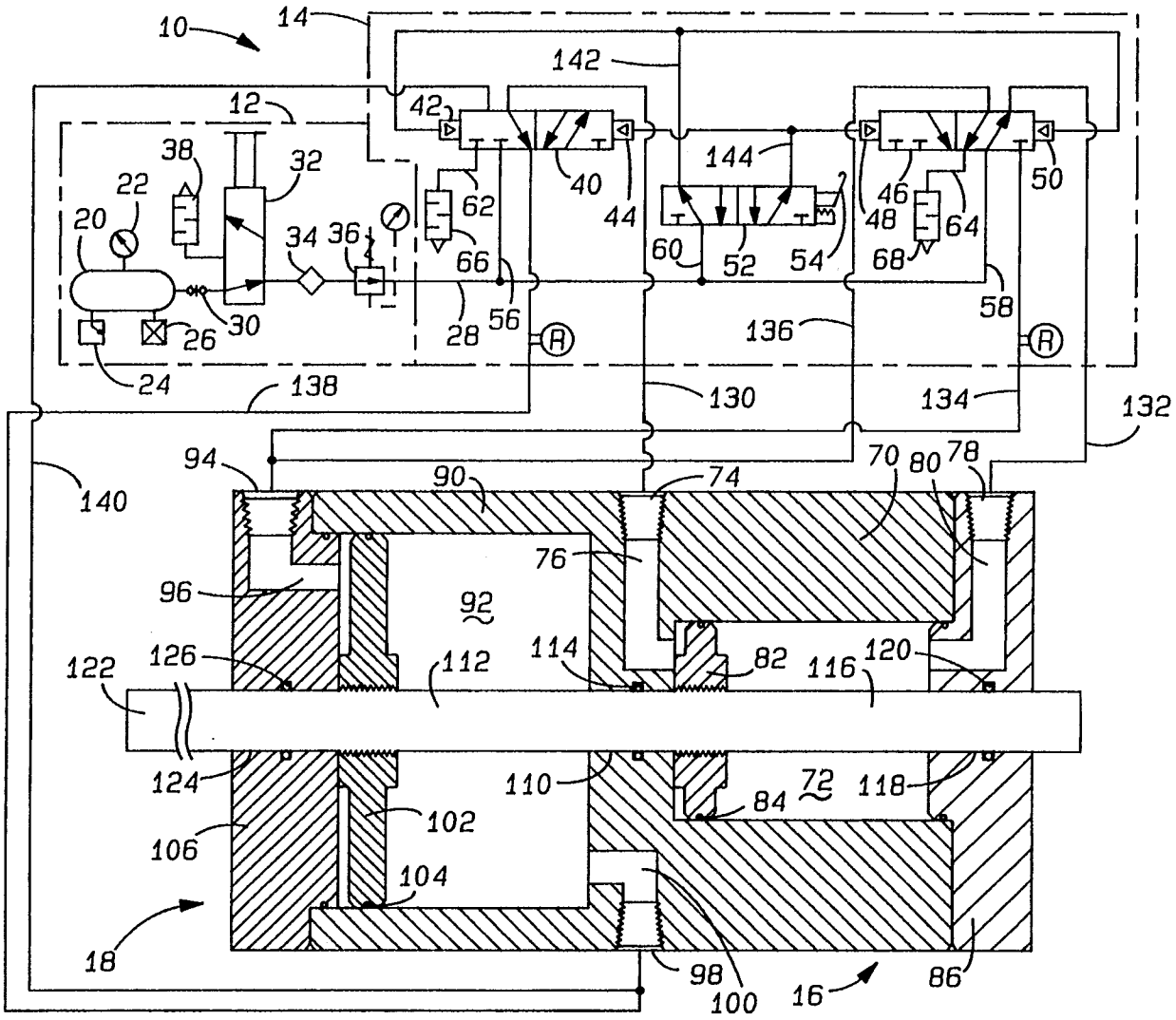
FIG. 1 is a schematic circuit diagram of the fluid intensifier of the present invention configured to increase the amount of applied load.

Referring now to the drawings in which like reference numerals designate like or corresponding parts throughout the several views, there is shown in FIG. 1 a fluid intensifier of the present invention which is generally designated by the reference numeral 10. Fluid intensifier 10 comprises a supply of pressurized fluid 12 (preferably pressurized air), a control system 14, a primary fluid cylinder 16 and a secondary fluid cylinder 18.

Figure 2:
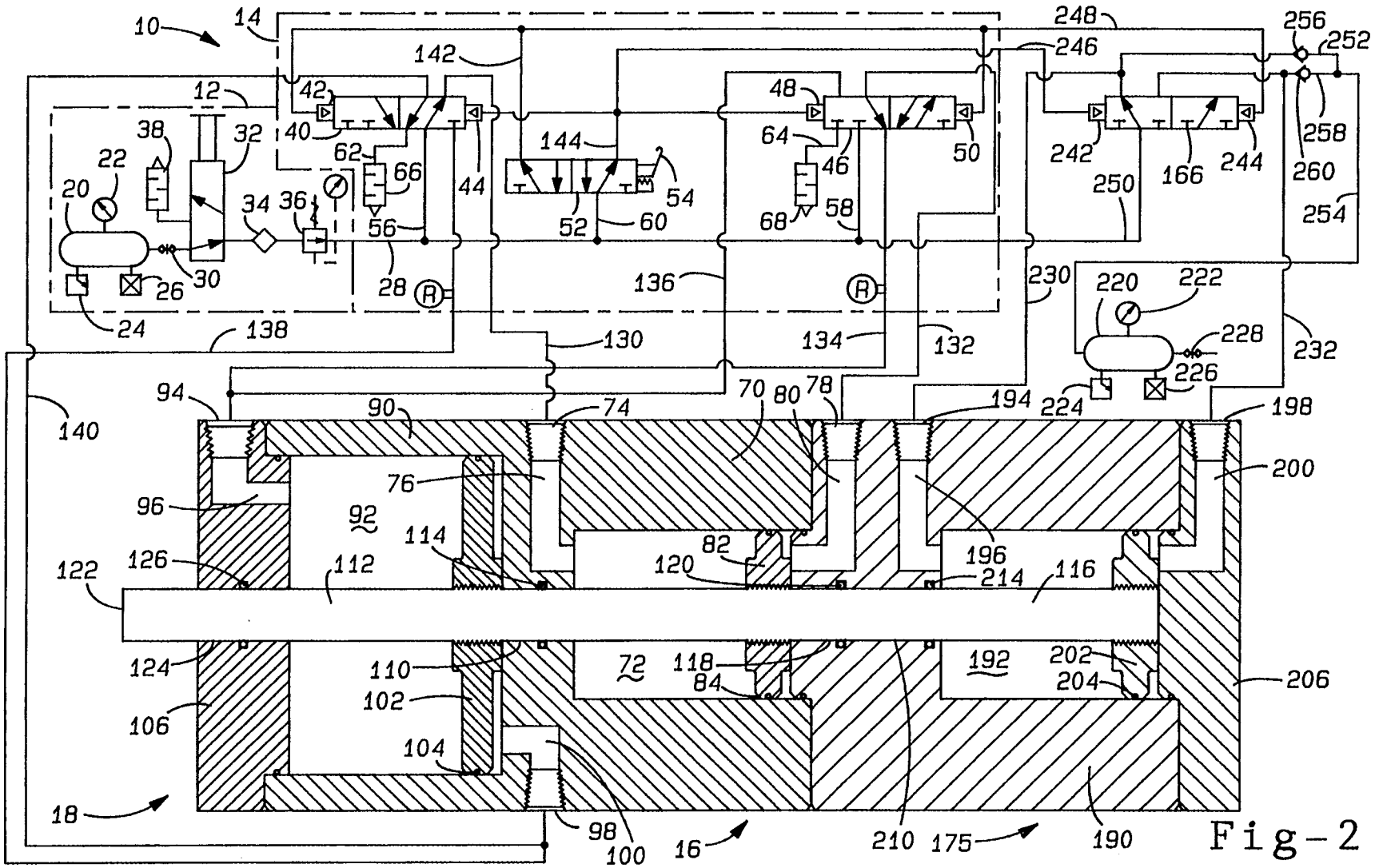
FIG. 2 is a schematic circuit diagram of the fluid intensifier of the present invention coupled with a third cylinder to increase the amount of working pressure.

The supply of pressurized fluid 12 will normally be comprised of a compressor (not shown), an accumulator 20, having the typical gauge 22, safety relief valve 24 and drain 26. Extending from accumulator 20 is a fluid pressure line 28 which directs the pressurized fluid through a fluid coupling 30, an on/off switch 32, a filter 34 and a regulator 36 before providing the pressurized fluid to control system 14. When on/off switch 32 is in the off position, the pressurized fluid within control system 14 and fluid cylinders 16 and 18 is vented to the atmosphere through muffler 38. When on/off switch 32 is in the on position, as shown in FIGS. 1 and 2, the pressurized fluid from accumulator 20 is supplied to control system 14 and fluid cylinders 16 and 18.

Control system 14 comprises two dual solenoid operated fluidic two position valves 40 and 46. Valve 40 is actuatable by solenoids 42 and 44 and valve 46 is actuatable by solenoids 48 and 50. Control system 14 further comprises a manually or automatically operated fluidic two position control valve 52. Valve 52 is shown as a manually operated valve which is actuatable by actuating lever 54 which moves valve 52 between its two positions to control the movement of valves 40 and 46 as well as cylinders 16 and 18 as will be described later herein.

Pressurized fluid is supplied to the lower end of valves 40, 46 and 52 from fluid pressure line 28 through fluid lines 56, 58 and 60 respectively. Valves 40 and 46 are vented to atmosphere through fluid lines 62 and 64 respectively with mufflers 66 and 68 being supplied to quiet the operation of valves 40 and 46 respectively.

Primary cylinder 16 is comprised of an outer housing 70 having an internal chamber 72 which is in fluid communication with a first port 74 through a passageway 76 and a second port 78 through a passageway 80. Disposed within chamber 72 is piston 82 which moves axially within chamber 72 under the influence of pressurized fluid being introduced to either first port 74 or second port 78. A seal 84 located between piston 82 and the inside wall of chamber 72 prohibits fluid from passing from one side of piston 82 to the other. An end cap 86 is sealingly secured to one end of housing 70 to close off one end of chamber 72. Passageway 80 is preferably located within end cap 86 as shown in FIG. 1 in order to insure free movement of piston 82 within chamber 72. Likewise, passageway 76 enters chamber 72 from an end face of chamber 72 as shown in FIG. 1 for the same reason.

Secondary cylinder 18 is comprised of an outer housing 90 having an internal chamber 92 which is in fluid communication with a first port 94 through a passageway 96 and a second port 98 through a passageway 100. Housing 90 may be separate from housing 70 or the two housings 70 and 90 may be integral with one another as shown in FIG. 1. Disposed within chamber 92 is a piston 102 which moves axially within chamber 92 under the influence of pressurized fluid being introduced to either first port 94 or second port 98. A seal 104 located between piston 102 an the inside wall of chamber 92 prohibits fluid from passing from one side of piston 102 to the other side. An end cap 106 is sealingly secured to one end of housing 90 to close off one end of chamber 92. Passageway 96 is preferably located within end cap 106 as shown in FIG. 1 in order to insure free movement of piston 102 within chamber 92. Likewise, passageway 100 enters chamber 92 from an end face of chamber 92 as shown in FIG. 1 for the same reason.

A centrally located bore 110 extends through housings 70 and 90 and is open to both chamber 72 and chamber 92. A piston rod 112 extends through bore 110 and is fixingly secured to pistons 82 and 102 such that pistons 82 and 102 move together axially within their respective chambers 72 and 92. A seal 114 is located between piston rod 112 and bore 110 to prohibit fluid movement between chambers 72 and 92. A second piston rod 116 extends axially from the side of piston 82 opposite to that of piston rod 112 and extends through a bore 118 located within end cap 86. A seal 120 located between bore 118 and piston rod 116 prohibits fluid movement between chamber 72 and the outside atmosphere. The purpose of piston rod 116 is to provide a mechanism for transferring the loads applied through the action of pistons 82 and 102. Piston rod 116 may be separate from piston rod 112 or piston rods 112 and 116 may be integral as shown in FIGS. 1 and 2. A third piston rod 122 extends axially from the side of piston 102 opposite to that of piston rod 112 and extends through a bore 124 located within end cap 106. A seal 126 located between bore 124 and piston rod 122 prohibits fluid movement between chamber 92 and the outside atmosphere. The purpose of piston rod 122 is to provide a mechanism for transferring the loads applied through the action of pistons 82 and 102. Piston rod 122 may be separate from piston rod 112 or piston rods 122 and 112 may be integral as shown in FIGS. 1 and 2.

Ports 74 and 78 of primary cylinder 16 and ports 94 and 98 of secondary cylinders 18 are put into communication with the upper and lower ends of valves 40 and 46 through a plurality of fluid lines. First port 74 is in communication with the upper end of valve 40 through a fluid line 130; second port 78 is in fluid communication with the upper end of valve 46 through a fluid line 132; first port 94 is in fluid communication with the lower end of valve 46 through fluid line 134 and with the upper end of valve 46 through fluid line 136; and second port 98 is in fluid communication with the lower end of valve 40 through fluid line 138 and with the upper end of valve 40 through fluid line 140.

The operation of fluid intensifier 10 will be explained as it relates to FIG. 1. FIG. 1 shows valves 40, 46 and 52 positioned to move pistons 82 and 102 to the left as shown in FIG. 1. Pistons 82 and 102 are shown moved fully to the left in FIG. 1.

Operation of fluid intensifier begins with the introduction of the compressed fluid from accumulator 20 by actuation of on/off switch 32. Pressurized fluid travels through fluid coupling 30, on/off switch 32, filter 34, regulator 36 and fluid line 28. Pressurized fluid is supplied to control valve 52 through fluid line 60. With control valve 52 in the position shown in FIG. 1, pressurized fluid is supplied from fluid line 60 through a fluid line 142 to both solenoids 42 and 50. Solenoids 42 and 50 position valves 40 and 46, respectively, as shown in FIG. 1. Valve 46, in this position, allows the flow of pressurized fluid from fluid line 28 through fluid line 58, through valve 46, through fluid line 132 to second port 78. The pressurized fluid moves from second port 78 through passageway 80 and into the right hand portion of chamber 72. The fluid pressure exerted against piston 82 urges piston 82 to the left with a force equal to the fluid pressure times the exposed area of piston 82. The fluid which is located in chamber 72 on the left hand side of piston 82 exits chamber 72 through port 74. The initial pressure of this fluid, contained within the left hand portion of chamber 72, is initially equal to the pressure of the fluid within supply line 28 (ignoring line losses) due to a previous cycle of fluid intensifier 10 as will be described later herein.

Simultaneous to the introduction of fluid pressure to solenoid 50 by valve 52 is the introduction of pressurized fluid to solenoid 42 as mentioned above. Solenoid 42 positions valve 40 as shown in FIG. 1 and valve 40, in this position, allows the transfer of pressurized fluid from the left side of chamber 72 to the right hand side of chamber 92 to increase and intensify the load exerted by piston rods 116 and/or 122. When piston 82 begins its movement to the left, the left side of chamber 72 is filled with pressurized fluid from the previous cycle. The actuation of solenoid 42 puts the left side of chamber 72 in communication with the right side of chamber 92. Pressurized fluid in the left side of chamber 72 travels from chamber 72 through passageway 76, through port 74, through fluid line 130 to the upper portion of valve 40. The fluid continues through valve 40, through fluid line 138, through port 98, through passageway 100 and into the right side of chamber 92 to exert an additional force on piston rods 112, 116 and/or 122. The additional force can be calculated by multiplying the pressure of the fluid by the size of the exposed area of piston 102. Piston 102 is larger than piston 82 to allow for the reduction of pressure of the fluid on the left hand side of piston 82 and thus allow the movement to the left of pistons 82 and 102. Although the fluid pressure on the right side of piston 102 is less than the supply pressure, the increase in area of piston 102 makes up for the loss of pressure when calculating the increase in load. In the preferred embodiment, secondary piston 102 is approximately four and one-half times the area of primary piston 82.

Simultaneous with the transfer of pressurized fluid between the left side of chamber 72 to the right side of chamber 92 by the switching of valve 40, the left side of chamber 92 is connected to atmosphere by valve 46 to dump the fluid pressure in the left side of chamber 92 to atmosphere. The fluid pressure in the left side of chamber 92 is the result of the previous cycle of fluid intensifier 10 and is equal to the fluid pressure within fluid line 28 divided by the ratio of the volume of chamber 92 to the volume of chamber 72. Fluid pressure within the left side of chamber 92 travels through passageway 96, through port 94, through fluid line 136 to the upper end of valve 46. From here, the fluid pressure travels through valve 46, through fluid line 64 and exits to atmosphere through muffler 68. Fluid intensifier 10 is thus able to significantly increase the load which will be exerted by piston rods 116 and/or 122 by the incorporation of secondary cylinder 18.

Upon completion of the stroke of cylinders 16 and 18 from the right in FIG. 1 to the left, the fluid pressure in the right side of chamber 72 is equal to the fluid pressure within fluid line 28. Control valve 52 is then actuated by actuating lever 54 and pressurize, d fluid is provided from fluid line 28 through fluid line 60, through control valve 52, through fluid line 144, to both solenoids 44 and 48. Solenoids 44 and 48 position valves 40 and 46 respectively in their second position, shown in FIG. 2, opposite to that shown in FIG. 1. Valve 40, in the second position, allows the flow of pressurized fluid from fluid line 28, through fluid line 56, through valve 40, through fluid line 130 to first port 74. The pressurized fluid moves from first port 74 through passageway 76 and into the left side of chamber 72. The fluid pressure exerted against piston 82 urges piston 82 to the right with a force equal to the fluid pressure times the exposed area of piston 82. The fluid which is located in chamber 72 on the right side of piston 82 exits chamber 72 through port 78. The pressure of the fluid contained within the right side of chamber 72 is initially equal to the pressure of the fluid within supply line 28 (ignoring line losses) due to the previous cycle of fluid intensifier 10 as described above.

Simultaneous to the introduction of fluid pressure to solenoid 44 by valve 52 is the introduction of pressurized fluid to solenoid valve 48 as mentioned above. Solenoid valve 48 positions valve 46 in its second position, as shown in FIG. 2, opposite to that shown in FIG. 1. Valve 46, in this position, allows the transfer of pressurized fluid from the right hand side of chamber 72 to the left hand side of chamber 92 to increase and intensify the load exerted by piston rods 116 and/or 122. When piston 82 begins its movement to the right, the right side of chamber 72 is filled with pressurized fluid from the previous cycle, as mentioned above. The actuation of solenoid valve 48 puts the right side of chamber 72 in communication with the left side of chamber 92. Pressurized fluid in the right side of chamber 72 travels from chamber 72, through passageway 80, through port 78, through fluid line 132 to the upper portion of valve 46. The fluid continues through valve 46, through fluid line 134, through port 94, through passageway 96 and into the left side of chamber 92 to exert an additional force on piston rods 112, 116 and/or 122. The additional force can be calculated by multiplying the pressure of the fluid by the size of the exposed area of piston 102. Piston 102 is larger than piston 82 to allow for the reduction of pressure of the fluid on the right hand side of piston 82 and thus allows the movement to the right of pistons 82 and 102. Although the fluid pressure on the left hand side of piston 102 is less than the supply pressure, the increase in area of piston 102 makes up for the loss of pressure when calculating the increase in load. In the preferred embodiment, secondary piston 102 is approximately four and one-half times the area of primary piston 82 as mentioned above.

Simultaneous with the transfer of pressurized fluid between the right side of chamber 72 to the left side of chamber 92 by switching of valve 46, the right side of chamber 92 is connected to atmosphere by valve 40 to dump the fluid pressure in the right side of chamber 92 to atmosphere. The fluid pressure in the right side of chamber 92 is the result of the previous cycle of intensifier 10 and is equal to the fluid pressure within fluid line 28 divided by the ratio of the volume of chamber 92 to the volume of chamber 72. Fluid pressure within the right side of chamber 92 travels through passageway 100, through port 98, through fluid line 140 to the upper end of valve 40. From here, the fluid pressure travels through valve 40, through fluid line 62 and exits to the atmosphere through muffler 66. Fluid intensifier 10 is thus able to significantly increase the load which will be exerted by piston rods 116 and/or 122 by the incorporation of secondary cylinder 18.

After completion of movement to the right, control valve 52 is switched by actuating lever 54 and the cycle again repeats itself. FIG. 2 shows another embodiment of the present invention where fluid intensifier 10 is combined with a third fluid cylinder 175 which is used to significantly increase the workable fluid pressure to an accumulator 220 located at a remote job sight. Accumulator 220 is equipped with the typical gauge 222, safety relief valve 224 and drain 226 similar to that of accumulator 20. A coupling device 228 may be incorporated at the remote job sight for coupling and uncoupling a fluid motor with accumulator 220 if desired.

Third fluid cylinder 175 is composed of an outer housing 190 having an internal chamber 192 which is in fluid communication with a first port 194 through passageway 196 and a second port 198 through passageway 200. Housing 190 may be separate from end cap 86 or housing 190 and end cap 86 may be integral with one another as shown in FIG. 2. In addition, third fluid cylinder 175 may be attached to the opposite end of fluid intensifier 10 and thus integral with or separate from end cap 106 if desired. Disposed within chamber 192 is piston 202 which moves axially within chamber 192 under the influence of load being applied to piston 202 by piston rod 116 as will be described later herein. A seal 204 located between piston 202 and the inside wall of chamber 192 prohibits fluid from passing from one side of piston 202 to the other side. An end cap 206 is sealingly secured to the end of housing 190 opposite to fluid intensifier 10 to close off the end of chamber 192. Passageway 200 is preferably located within end cap 206 as shown in FIG. 2, in order to insure free movement of piston 202 within chamber 192. Likewise, passageway 196 enters chamber 192 from an end face of chamber 192 as shown in FIG. 2 for the same reason.

A centrally located bore 210 extends through housing 190 to mate with bore 118. Piston rod 116 extends through bore 210 and is fixedly secured to piston 202 such that piston 202 is driven by piston rod 116 to move axially within chamber 192 due to the axial movement of pistons 82 and 102. A seal 214 is located between piston rod 116 and bore 210 to prohibit movement of fluid between chambers 72 and 192.

Ports 194 and 198 of third cylinder 175 are put into communication with a third dual solenoid fluidic two position valve 166 through fluid lines 230 and 232 respectively. Valve 166 is actuatable by solenoids 242 and 244. Solenoid 242 is in communication with fluid line 144 via fluid line 246 and solenoid 244 is in communication with fluid line 142 via fluid line 248. Thus, valve 166 is operative to function simultaneously with valves 40 and 46 through the switching of control valve 52. Valve 166 is shown in its second position which is a result of actuation of solenoid 242 due to fluid pressure being applied to fluid line 246 through fluid line 144 and control valve 52. In this position, the left side of chamber 192 is open to fluid pressure from fluid line 28 through a fluid line 250, through valve 166, through fluid line 230, through port 194, through passage 196 and into the left side of chamber 192. The right side of chamber 192 is open to a fluid line 258 via passageway 200, through port 198, through fluid line 232 and into fluid line 258. Fluid line 258 is connected to a fluid line 254 which leads to accumulator 220. A check valve 260 prohibits fluid flow from accumulator 220 back to the right side of to chamber 192. An additional fluid line 252 connects valve 166 to fluid line 254 through another check valve 256.

Simultaneous to the introduction of fluid pressure to solenoid 48 by control valve 52 is the introduction of pressurized fluid to solenoid 242 as mentioned above. Solenoid 242 positions valve 166 as shown in FIG. 2 and valve 166, allows the transfer of pressurized fluid from the right side of chamber 192 to accumulator 220 to provide a higher pressure working fluid. When piston 202 begins its movement to the right, the right side of chamber 192 is filled with pressurized fluid from the previous cycle. The actuation of solenoid 242 puts the left side of chamber 192 in communication with the fluid supply source. Pressurized fluid travels through fluid line 28, through fluid line 250, to valve 166. From valve 166, pressurized fluid travels through fluid line 230, through port 194, through passageway 196 to the left side of chamber 192. Pressurized fluid also travels through check valve 256, through fluid line 252, through fluid line 254 and into accumulator 220 as long as the pressure within fluid line 28 is greater than the pressure within accumulator 220. Check valve 256 prohibits fluid movement in the opposite direction. The actuation of solenoid 242 also operates to disconnect the right side of chamber 192 from valve 166. Thus, the right side of chamber 192 is left in communication with accumulator 220 and pressurized fluid will flow from the right side of chamber 192 to accumulator 220 as long as the pressure within the right side of chamber 192 exceeds the pressure in accumulator 220. Check valve 260 prohibits fluid motion in the opposite direction. As stated above, the initial fluid pressure within the right side of chamber 192 is equal to the fluid pressure within fluid line 28 due to the previous cycle of fluid intensifier 10. As piston 202 moves from left to right in FIG. 2, the fluid within the right side of chamber 192 is compressed and forced through check valve 260 to accumulator 220. Due to the increase of the load caused by secondary cylinder 18 working in conjunction with primary cylinder 16, the fluid pressure can be significantly increased between fluid line 28 and accumulator 220.

Upon completion of the stroke of cylinders 16, 18 and 175 from the left in FIG. 2 to the right, the fluid pressure in the left side of chamber 192 is equal to the fluid pressure within fluid line 28. The actuation of control valve 52 provides pressurized fluid from fluid line 28 through fluid line 60, through control valve 52, through fluid line 142, through fluid line 248 to solenoid 244. Solenoid 244 positions valve 166 in its first position, opposite to that shown in FIG. 2. Valve 166, in the first position, allows the flow of pressurized fluid from flow line 28, through fluid line 250, through valve 166, through fluid line 232 to port 198. The pressurized fluid moves from port 198 through passageway 200 and into the right side of chamber 192. The fluid which is located in chamber 192 on the left side of piston 202 exits chamber 192 through port 194. The pressure of the fluid contained within the left side of chamber 192 is initially equal to the pressure of the fluid within supply line 28 due to the previous cycle of fluid intensifier 10 as described above. As piston 202 moves from right to left in FIG. 2, the fluid within the left side of chamber 192 is compressed and forced through passageway 196, through port 194, through fluid line 230, through fluid line 252, through fluid line 254 and into accumulator 220. Due to the increase of the load caused by secondary cylinder 18 working in conjunction with primary cylinder 16, the fluid pressure can be significantly increased between fluid line 28 and accumulator 220. Check valve 256 allows fluid flow between chamber 192 and accumulator 220 only when the pressure within chamber 192 is greater than the pressure within accumulator 220.

After completion of movement to the left, control valve 52 is switched by actuating lever 54 and the cycle again repeats itself.

Figure 3:
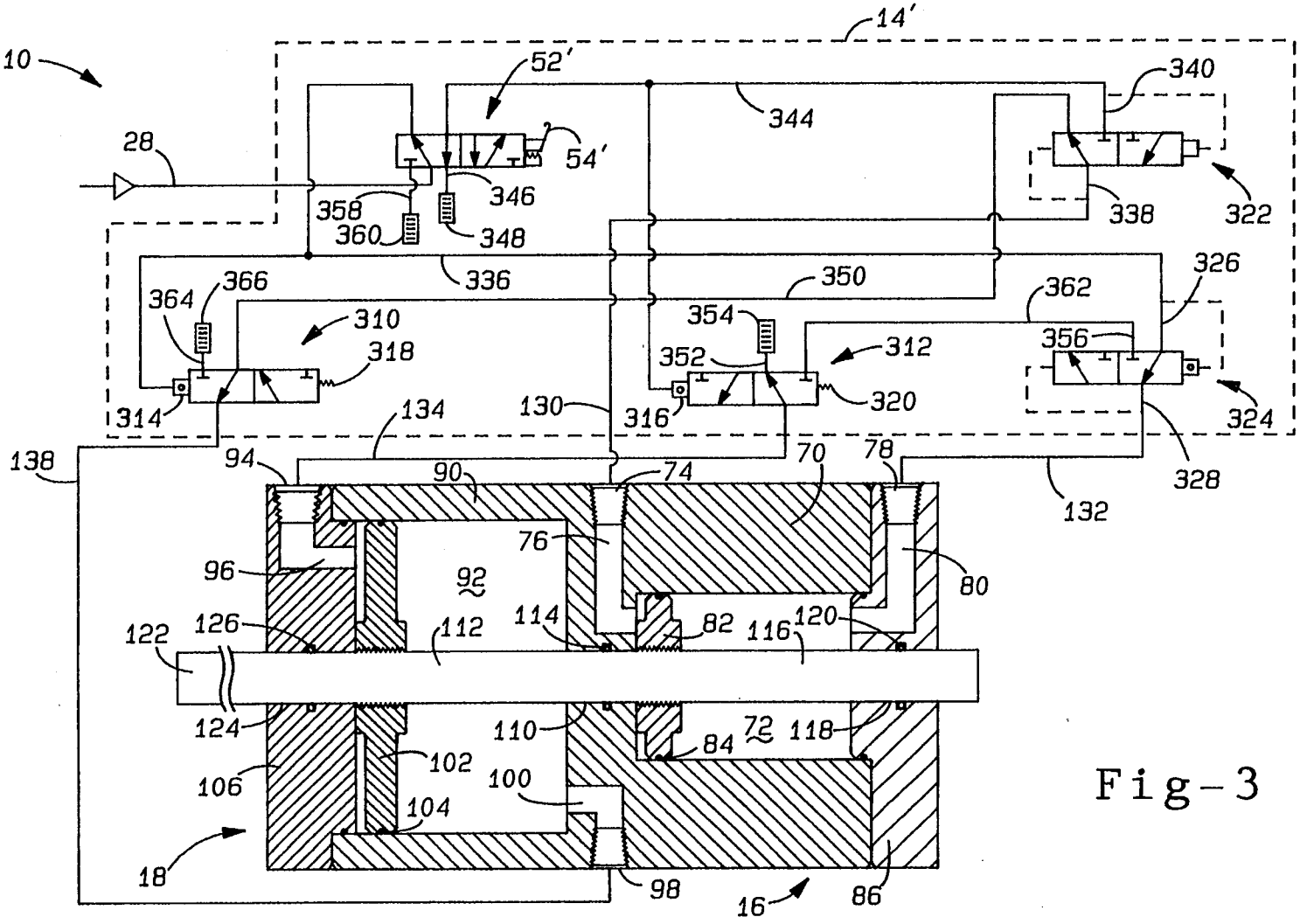
FIG. 3 is a schematic circuit diagram of the fluid intensifier of the present invention configured to decrease the cycle time required.

A further embodiment of the present invention is shown in FIG. 3. In FIG. 3, like or corresponding components have been given the same reference numerals as those components in FIG. 1. FIG. 3 represents a variation of a control system 14′ used to significantly increase the cycle speed of fluid intensifier 10. Control system 14′ receives pressurized fluid from supply 12 via fluid pressure line 28 in an identical manner to control system 14 described above. In addition, control system 14′ can be combined with fluid intensifier 10 and third fluid cylinder 175 in an identical manner as control system 14 as shown in FIG. 2.

Control system 14′ comprises two single solenoid operated fluidic two-position valves 310 and 312. Valve 310 is actuated by solenoid 314 and valve 312 is actuated by solenoid 316. When solenoids 314 and 316 are not activated, valves 310 and 312 are held in a first position by return springs 318 and 320, respectively. Control system 14′ further comprises two quick exhaust valves 322 and 324.

Figure 4:
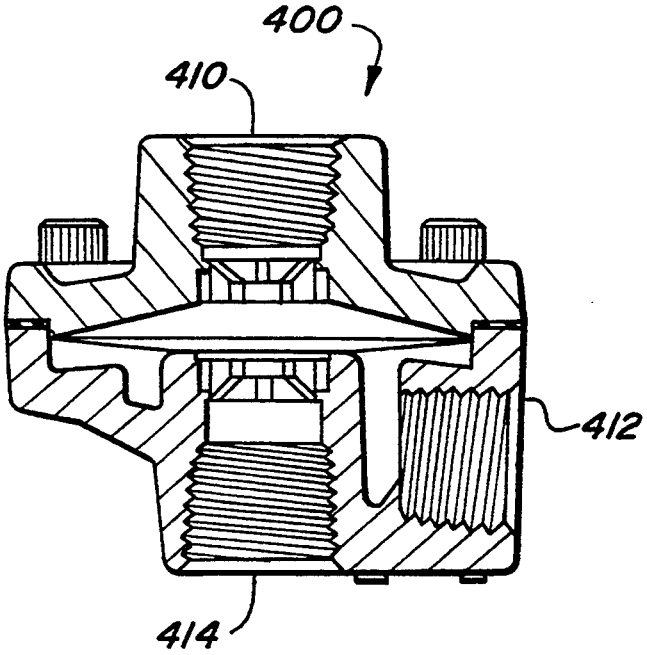
FIG. 4 is a cross-sectional view of a quick exhaust valve.

A typical quick exhaust valve similar to valves 322 and 324 is shown in FIG. 4 and is designated by the reference numeral 400. Quick exhaust valve 400 comprises three ports 410, 412, and 414. Quick exhaust valve 400 significantly increases the exhaust capacity or fluid flow through valve 400. This permits greater cylinder speeds without increasing the size of the control valves. Exhaust valve 400 is manufactured by Parker Fluid Power as model number OR25B. When pressurized fluid is supplied to port 410, flow from port 410 proceeds through valve 400 and exhausts through port 412 with port 414 being blocked from the flow of fluid. When pressurized fluid is vented from port 410, flow from port 412 proceeds through valve 400 and exhausts through 414 with port 410 being blocked from the flow of fluid.

Referring now to FIG. 3, control system 14′ further comprises manually or automatically operated fluidic two-position control valve 52′. Control valve 52′ is shown as a manually operated valve which is actuatable by actuating lever 54′ which moves valve 52′ between its two positions to control the movement of valves 310, 312, 322 and 324 as well as cylinders 16 and 18 as will be described later herein.

Pressurized fluid is supplied to the lower end of control valve 52' from fluid pressure line 28. FIG. 3 shows control system 14' in a position to move shafts 122, 112, and/or 116 to the left. Pressurized fluid is supplied from the top of control valve 52' to solenoid 314 of valve 310 and port 326, the equivalent of port 410 in FIG. 4, of quick exhaust valve 324 through fluid pressure line 336. Valve 310 is forced from its first position to its second position as shown in FIG. 3, by the pressure applied to solenoid 314 through line 336 and simultaneously quick exhaust valve 324 is placed in a condition where pressurized fluid passes from port 326, the equivalent of port 410 in FIG. 4, to port 328, the equivalent of port 412 in FIG. 4. In this position, quick exhaust valve 324 allows the flow of pressurized fluid from fluid pressure line 28 through control valve 52', through line 336, through quick exhaust valve 324, through fluid line 132 to second port 78. The pressurized fluid moves from second port 78 through passageway 80 and into the right hand portion of chamber 72 as shown in FIG. 3. As previously described in reference to FIG. 1, the fluid pressure exerted against piston 82 urges piston 82 to the left. The fluid which is located in chamber 72 on the left side of piston 82 exits chamber 72 through port 74 which is in fluid communication with chamber 72 through passageway 76.

Pressurized fluid from the left side of chamber 72 flows from port 74, through line 130 to port 338, the equivalent of port 412 in FIG. 4, of quick exhaust valve 322. When port 340, the equivalent of port 410 in FIG. 4, is vented, flow through valve 322 is from port 338, the equivalent of port 412 in FIG. 4, through port 342, the equivalent of port 414 in FIG. 4. In this position, port 340 is vented through control valve 52' with port 340 being in fluid communication with valve 52' by means of line 344. Control valve 52' is vented to atmosphere through fluid line 346, with muffler 348 being supplied to quiet the operation of valve 52'.

As indicated in the previous reference to FIG. 4, quick exhaust valves 322 and 324 provide significant increase in the exhaust capacity of fluid flow through the quick exhaust valves. The increased capacity of the exhaust valves allow for faster cycle times for the cylinders because the transfer of fluid from one side of chamber 72 to the opposite side of chamber 92 is at a higher rate than with conventional valve systems of equivalent size.

The pressurized fluid flows from port 342 of valve 322 to the right side of chamber 92 through line 350 to the top of valve 310. Valve 310, in its second position do to the activation of solenoid 314, directs the pressurized fluid through line 138. Line 138 is in communication with port 98, which is in fluid communication with the right side of chamber 92 by way of passageway 100.

Again, because of the increased area of piston 102, as compared to piston 82, there is a decrease in pressure of the fluid which flows from the left side of piston 82 in chamber 72 to the right side of piston 102 in chamber 92. Although the pressure on the right side of piston 102 is less than the supply pressure, the increase in area of piston 102 makes up for the loss of pressure when calculating the increase in load.

As piston 102 moves to the left as shown in FIG. 3, fluid is displaced from chamber 92 through passageway 96, through port 94, through line 134 to the bottom end of valve 312. Valve 312 is located in a first position since solenoid 316 is vented to atmosphere through line 344, through control valve 52', through line 346 to muffler 348 which functions to quiet the operation of valve 52'. With valve 312 in its first position the fluid in line 134 is placed in fluid communication with line 352 and subsequently vented by way of muffler 354 which is open to the atmosphere and provided to quiet the operation of valve 312.

Upon completion of the stroke of cylinders 16 and 18 from the right in FIG. 3 to the left, the fluid pressure in the right side of chamber 72 is equal to the fluid pressure within fluid line 28. Control valve 52' is then actuated by actuating lever 54' and pressurized fluid is provided from fluid line 28 through control valve 52', through line 344 to solenoid 316 of valve 312, and simultaneously to port 340 of quick exhaust valve 322. The pressure in line 344 activates solenoid 316 which forces valve 312 from its first position to its second position (opposite to that shown in FIG. 3).

Quick exhaust valve 322 is placed in a condition, do to the pressure in line 344, where flow is from port 340 to port 338 with port 342 being blocked from the fluid flow. The pressurized fluid flows from port 338 through line 130 to first port 74. The pressurized fluid moves from port 74 through passageway 76 and into the left side of chamber 72. The fluid pressure exerted against piston 82 urges piston 82 to the right. The fluid which is located in chamber 72 on the right side of piston 82 is forced to exit chamber 72 through port 78 which is in fluid communication with chamber 72 by way of passageway 80.

Pressurized fluid from the right side of chamber 72 flows from port 78, through line 132 to port 328 of quick exhaust valve 324. When port 326 is vented, flow is from port 328 through port 356, the equivalent of port 414 in FIG. 4. Here, port 326 is vented through control valve 52' which is in fluid communication with port 326 by means of line 336. Control valve 52' is vented to the atmosphere through fluid line 358, with muffler 360 being supplied to quiet the operation of valve 52'.

The pressurized fluid then flows from port 356 through line 362 to the top end of valve 312 which is in its second position, as previously described. The fluid flows through valve 312, through line 134, through port 94 through passageway 96 and into the left side of chamber 92 to exert force upon piston 102, urging piston 102 to the right.

The fluid which is located in chamber 92 on the right side of piston 102 is forced to exit chamber 92 through port 98 which is in fluid communication with chamber 92 by way of passageway 100. The fluid then flows from port 98 through line 138 to the bottom end of valve 310, which is in a first position since line 336 is not pressurized and therefore solenoid 314 is not activated. With valve 310 in its first position the fluid is directed from line 138 through valve 310, through a line 364, and is vented to the atmosphere through a muffler 366 which is provided to quiet the operation of valve 310.

After completion of movement to the right, control valve 332 is again switched by actuating lever 334 and the cycle is repeated.

While the above detailed description describes the preferred embodiment of the present invention, it should be understood that the present invention is susceptible to modification, variation and alteration without deviating from the scope and fair meaning of the subjoined claims.

What is claimed is:

1. A fluid operated device comprising:

output means operatively associated with said fluid operated device;

a first extensible fluid motor means having first means therein for transmitting power from said first fluid motor to said output means;

a second extensible fluid motor means having second means therein for transmitting power from said second fluid motor to said output means, said second power transmitting means being operatively connected to said first power transmitting means;

a first valve member in fluid communication with said first and second fluid motor means, said first valve member being movable to a first position and a second position, said first valve member operable in said first position to place one side of said first power transmitting means in fluid communication with a pressurized source of fluid and one side of said second power transmitting means in fluid communication with atmosphere, said first valve member operable in said second position to place said one side of said first power transmitting means in fluid communication with said one side of said second power transmitting means, said first valve member including a first quick exhaust valve;

a second valve member in fluid communication with said first and second fluid motor means, said second valve member being movable to a first position and a second position, said second valve member operable in said first position to place the opposite side of said first power transmitting means in fluid communication with the opposite side of said second power transmitting means, said second valve member operable in said second position to place said opposite side of said first power transmitting means in fluid communication with said pressurized source of fluid and said opposite side of said second power transmitting means in fluid communication with atmosphere, said second valve member including a second quick exhaust valve; and a control valve in fluid communication with said first and second valve members said control valve being movable to a first position and a second position, said control valve operable in said first position to place said first and second valve members in said first positions such that the power transmitted to said output means by said first and second power transmitting means is additive in a first direction, said control valve operable in said second position to place said first and second valve members in said second positions such that the power transmitted to said output means by said first and second power transmitting means is additive in a second direction.

2. The fluid operated device according to claim 1 wherein said control valve is in fluid communication with said pressurized source of fluid.

3. The fluid operated device according to claim 1 wherein said first valve member includes a two way valve, said two way valve being biased into said first position.

4. The fluid operated device according to claim 1 wherein said second valve member includes a two way valve, said two way valve being biased into said second position.

5. The fluid operated device according to claim 1 further comprising:

a third extensible fluid motor having means therein for compressing a working fluid, said compressing means being operatively connected to said output means of said fluid operated device;

a second control valve in fluid communication with said compressing means, said second control valve being movable to a first position and a second position, said second control valve operable in said first position to place one side of said compressing means in communication with a reservoir of said working fluid, and the opposite side thereof in fluid communication with a source of said working fluid, said second control valve operable in said second position to place said opposite side of said compressing means in communication with said reservoir of said working fluid and said one side thereof in fluid communication with said source of said working fluid.

6. The fluid operated device according to claim 5 wherein said control valve places said second control valve in its said first position when said control valve is in its said first position and said control valve places said second control valve in its said second position when said control valve is in its said second position.

7. The fluid operated device according to claim 5 wherein said pressurized source of fluid is operable to move said second control valve between its said first and second positions.

8. The fluid operated device according to claim 5 wherein said source of said working fluid is said pressurized source of fluid.

9. A fluid operated device comprising:

output means operatively associated with said fluid operated device;

a first extensible fluid motor means having first means therein for transmitting power from said first fluid motor to said output means;

a second extensible fluid motor means having second means therein for transmitting power from said second fluid motor to said output means, said second power transmitting means being operatively connected to said first power transmitting means;

a first valve member in fluid communication with said first and second fluid motor means, said first valve member being movable to a first position and a second position, said first valve member operable in said first position to place one side of said first power transmitting means in fluid communication with a pressurized source of fluid and one side of said second power transmitting means in fluid communication with atmosphere, said first valve member operable in said second position to place said one side of said first power transmitting means in fluid communication with said one side of said second power transmitting means, said first valve member including a first quick exhaust valve and a first two-way valve;

a second valve member in fluid communication with said first and second fluid motor means, said second valve member being movable to a first position and a second position, said second valve member operable in said first position to place the opposite side of said first power transmitting means in fluid communication with the opposite side of said second power transmitting means, said second valve member operable in said second position to place said opposite side of said first power transmitting means in fluid communication with said pressurized source of fluid and said opposite side of said second power transmitting means in fluid communication with atmosphere, said second valve member including a second quick exhaust valve and a second two-way valve; and a control valve in fluid communication with said first and second valve members said control valve being movable to a first position and a second position, said control valve operable in said first position to place said first and second valve members in said first positions such that the power transmitted to said output means by said first and second power transmitting means is additive in a first direction, said control valve operable in said second position to place said first and second valve members in said second positions such that the power transmitted to said output means by said first and second power transmitting means is additive in a second direction.

10. The fluid operated device according to claim 9 wherein said control valve is in fluid communication with said pressurized source of fluid.

11. The fluid operated device according to claim 9 wherein said first two-way valve is biased into said first position.

12. The fluid operated device according to claim 9 wherein said second two-way valve is biased into said second position.

13. The fluid operated device according to claim 9 further comprising:

a third extensible fluid motor having means therein for compressing a working fluid, said compressing means being operatively connected to said output means of said fluid operated device;

a second control valve in fluid communication with said compressing means, said second control valve being movable to a first position and a second position, said second control valve operable in said first position to place one side of said compressing means in communication with a reservoir of said working fluid, and the opposite side thereof in fluid communication with a source of said working fluid, said second control valve operable in said second position to place said opposite side of said compressing means in communication with said reservoir of said working fluid and said one side thereof in fluid communication with said source of said working fluid.

14. The fluid operated device according to claim 13 wherein said control valve places said second control valve in its said first position when said control valve is in its said first position and said control valve places said second control valve in its said second position when said control valve is in its said second position.

15. The fluid operated device according to claim 13 wherein said pressurized source of fluid is operable to move said second control valve between its said first and second positions.

16. The fluid operated device according to claim 13 wherein said source of said working fluid is said pressurized source of fluid.

* * * * *